US005450895A

United States Patent [19]

Peery

[11] Patent Number: 5,450,895

[45] Date of Patent: Sep. 19, 1995

[54] APPARATUS FOR SEPARATING BALLS FROM FLUID, PARTICULARLY FOR SYSTEMS USING THE BALLS FOR CLEANING FLUID-CONDUCTING TUBING

[75] Inventor: Moshe Peery, Kibbutz Yotvata, Israel

[73] Assignee: C.Q.M. Ltd., Rishon Lezion, Israel

[21] Appl. No.: 258,887

[22] Filed: Jun. 13, 1994

Related U.S. Application Data

[63] Continuation-in-part of Ser. No. 154,062, Nov. 18, 1993, Pat. No. 5,388,636.

[51] Int. Cl.[6] ..... F28G 1/12

[52] U.S. Cl. ..... 165/95; 15/3.51

[58] Field of Search ..... 165/95; 15/3.5, 3.51, 15/104.062

[56] References Cited

U.S. PATENT DOCUMENTS 4,620,589 11/1986 Koller ..... 165/95
4,865,121 12/1989 Ben-Dosa ..... 165/95
5,086,833 2/1992 Ben-Dosa ..... 165/95
5,176,204 1/1993 Ben-Dosa ..... 165/95

FOREIGN PATENT DOCUMENTS 238397 10/1988 Japan ..... 165/95

*Primary Examiner*—Martin P. Schwadron
*Assistant Examiner*—L. R. Leo
*Attorney, Agent, or Firm*—Mark M. Friedman

[57] ABSTRACT

A cleaning system using balls for cleaning fluid-conducting tubing including separation apparatus for separating the balls before recirculation by ball recirculation apparatus. The separation apparatus includes a conduit having an inlet in flow communication with the downstream side of the tubing, a ball outlet connected to the inlet of the ball recirculation apparatus and a fluid outlet connected to an outlet fluid line, and a generally cylindrical sieve substantially extending between the inlet and the ball outlet.

17 Claims, 5 Drawing Sheets

APPARATUS FOR SEPARATING BALLS FROM FLUID, PARTICULARLY FOR SYSTEMS USING THE BALLS FOR CLEANING FLUID-CONDUCTING TUBING

The present application is a Continuation-in-Part of U.S. Patent application Ser. No. 08/154,062 filed Nov. 18, 1993, now U.S. Pat. No. 5,388,636.

FIELD AND BACKGROUND OF THE INVENTION

The present invention relates to systems using balls for cleaning the inside of fluid-conducting tubing in condensers and other forms of heat-exchangers in general and in particular to separation apparatus for separating balls from a flow of fluid entraining the balls incorporated within such systems.

Systems using balls for cleaning the inside of fluid-conducting tubing for preventing the build-up of coatings or any other fouling inside the tubing are known in the art. Such systems include ball recirculation apparatus for recirculating the balls through the tubing having an inlet at the downstream side of the tubing and an outlet at the upstream side of the tubing. Separation apparatus deployed between the downstream side of the tubing and the inlet to the ball recirculation apparatus separates the balls from the flow of fluid entraining the balls after each pass through the tubing.

It is well known that separation apparatus which does not facilitate the ready separation of balls before their delivery to the ball recirculation apparatus detracts from the overall efficiency of the systems. There is thus a widely recognized need for, and it would be highly advantageous to have a low cost, simple and efficient separation apparatus for separating balls from a flow of fluid entraining the balls in systems using balls for cleaning the inside of fluid-conducting tubing.

SUMMARY OF THE INVENTION

The main object of the present invention is for a low cost, simple and efficient separation apparatus for separating balls from a flow of fluid entraining the balls in systems using the balls for cleaning the inside of fluid-conducting tubing in condensers and other forms of heat exchangers.

Hence, there is provided according to the present invention, a separation apparatus for separating a plurality of balls circulating through tubing having an upstream side and a downstream side, the separation occurring at the downstream side of the tubing, the separation apparatus comprising: (a) a conduit having an inlet in flow communication with the downstream side of the tubing, a ball outlet connected to a ball recirculation apparatus for recirculating the plurality of balls to the upstream side of the tubing and a fluid outlet connected to the upstream side of the tubing; and (b) a generally cylindrical sieve substantially extending lengthwise between the inlet and the ball outlet in the conduit for trapping the plurality of balls therein as fluid continually flows from the inlet to the fluid outlet.

According to further features of the present invention, the cross-sectional area of the inlet is substantially equal to the cross-sectional area of the neck of the tubing while the cross-sectional area of the sieve is substantially equal to the cross-sectional area of the inlet. Furthermore, the total open area of the sieve is at least approximately five times its cross-sectional area.

According to still further features of the present invention, the ball outlet is located substantially center to the sieve while the sieve can include a non-perforated portion, converge from the inlet towards the ball outlet or to include a constricted waist portion to improve the evacuation of the balls from the separation apparatus.

According to yet still further features, the separation apparatus can include one or more of the following modifications: apparatus for reducing turbulence in the flow of fluid within the vicinity of the fluid outlet, apparatus for reducing turbulence in the flow of fluid within the vicinity of the ball outlet, apparatus for urging the plurality of balls toward the ball outlet, and apparatus for compacting the motion of the plurality of balls such that the excursion of the plurality of balls from the axis of the ball outlet is decreased.

A second embodiment of the system includes a second separation apparatus in parallel with the first separation apparatus, the second separation apparatus including a conduit having an inlet in flow communication with the downstream side of the tubing, a ball outlet connected to the inlet of the ball recirculation apparatus and a fluid outlet connected to an outlet fluid line, and a generally cylindrical sieve substantially extending between the inlet and the ball outlet. Preferably, the inlet of the second separation apparatus is substantially opposite the inlet of the first separation apparatus and the system further comprises first and second valves deployed on the first and second fluid outlets, respectively.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a separation apparatus for separating balls from a flow of fluid entraining the balls in a system using the balls for cleaning the inside of fluid-conducting tubing in condensers and other forms of heat exchangers.

The principles and operation of the separation apparatus according to the present invention may be better understood with reference to the drawings and the accompanying description.

Figure 1A:
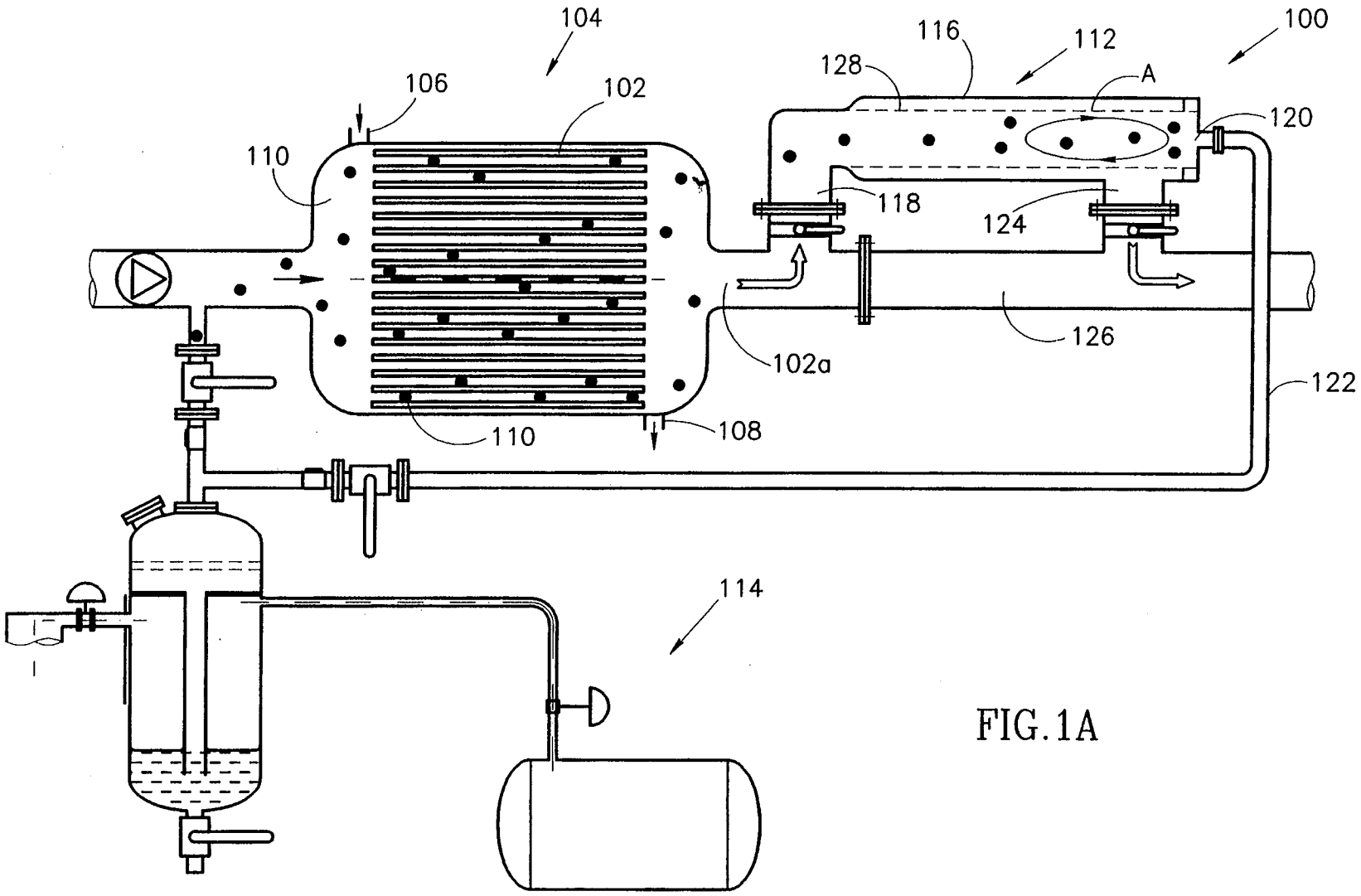
FIGS. 1*a* and 1*b* are schematic views of a system using balls for cleaning the inside of fluid-conducting tubing including a preferred embodiment of separation apparatus, constructed and operative according to the teachings of the present invention, before and during the evacuation of the balls therefrom, respectively.
Figure 1B:
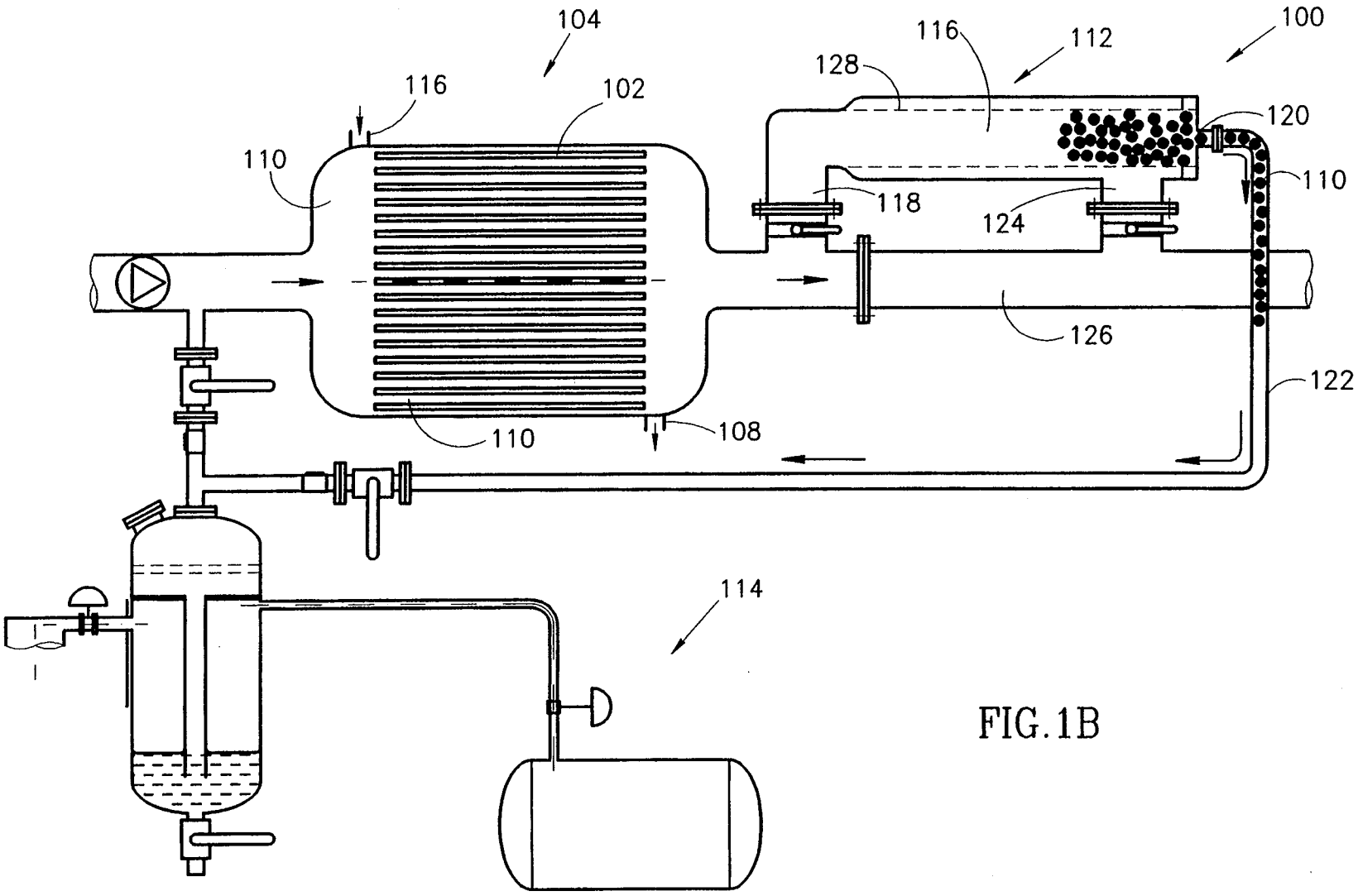

With reference now to the drawings, FIGS. 1*a* and 1*b* show a system, generally designated 100, for cleaning the inside of fluid-conducting tubing 102 of a condenser 104. Condenser 104 is used for condensing a fluid, such as steam or a refrigerant gas, circulated from an inlet 106 through the spaces between tubing 102 to an outlet 108.

In order to prevent the lodging or settling of particles within condenser tubing 102, system 100 includes a plurality of balls 110 which are forced through tubing 102 for cleaning same of bacteria or scale as it forms. Separation apparatus, generally designated 112, constructed and operative according to the teachings of the present invention, at the downstream side of tubing 102 separates balls 110 from fluid entraining balls 110 thereinto. Balls 110 are delivered to a ball recirculation apparatus, generally designated 114, for injection at a positive fluid pressure to the upstream side of tubing 102.

Separation apparatus 112 includes a shunt conduit 116 having an inlet 118 in flow communication with the downstream side of tubing 102, a ball outlet 120 connected to the inlet of ball recirculation apparatus 114 via a ball conduit 122 and a fluid outlet 124 connected to an outlet fluid line 126. A generally cylindrical sieve 128 substantially extends from inlet 118 to ball outlet 120 such that balls 110 are confined within a substantially closed volume therebetween.

The manner by which separation apparatus 112 separates balls 110 from the flow of fluid entraining them is now explained to enable a better appreciation of the design features incorporated within apparatus 112 as described hereinbelow. Balls 110 are stored in ball recirculation apparatus 114 before injection into the upstream side of tubing 102. After their injection, balls 110 pass through tubing 102 and are collected in sieve 128 of separation apparatus 112. Within the confines of sieve 128, balls 110 perform a generally, slow moving ellipsoid motion denoted A as fluid flows from the downstream side of tubing 102 through conduit 116 to outlet fluid line 126.

After a pre-determined time, typically sufficient to enable most, if not all, of balls 110 to be entrapped in sieve 128, recirculation apparatus 114 is activated such that the prevailing pressure within ball conduit 122 suddenly drops below the prevailing pressure within outlet fluid line 126. The sudden pressure drop causes a relatively abrupt diversion in the flow of fluid through separation apparatus 112 such that most of the fluid is discharged through ball outlet 120 along ball conduit 122 instead of through fluid outlet 124 along outlet fluid line 126. Hence, in sharp contrast to the gentle motion of balls 110 within sieve 128, balls 110 are evacuated from sieve 128 by an intense vortex of fluid entraining balls 110 through ball outlet 120 for delivery to ball recirculation apparatus 114.

After evacuation of balls 110, ball recirculation apparatus 114 is activated such that the fluid flowing through separation apparatus 112 reverts back to flow through fluid outlet 124 to outlet fluid line 126. The above cycle is performed periodically according to the rate of deposit of coatings and other matters on the inside of condenser tubing 102.

The design features preferably embodied within separation apparatus 112 to achieve the complete evacuation of balls 110 from sieve 128 are as follows. First, the cross-sectional areas of the neck 102*a* of condenser tubing 102, inlet 118 and sieve 128 are substantially the same, thereby ensuring a generally smooth, laminar flow of fluid from tubing 102 through separation apparatus 112 to fluid outlet line 126. Second, the pressure differential across the wall of sieve 128 is preferably as close to zero as possible, thereby ensuring that balls 110 are not urged against the wall of sieve 128 during their motion within the confines of sieve 128 but rather circulate freely within the body of fluid circulating therewithin. This pressure differential is best achieved by providing sieve 128 with a total open area of at least approximately five times its cross-sectional area. However, if the cross-sectional areas of the neck 102*a* of tubing 102, inlet 118 and sieve 128 are not the same, then the total open area of sieve 128 should be at least approximately five times the cross-sectional area of the rate determining portion which is typically neck 102*a* of tubing 102. It should be noted that the total open area of a sieve is defined as the total area of its perforations. Third, ball outlet 120 is preferably disposed at the center of sieve 128 for best facilitating the generation of the intense vortex as the prevailing pressure within ball conduit 122 drops below the prevailing pressure within outlet fluid line 126, thereby ensuring a complete evacuation of balls 110 from separation apparatus 112.

Figure 2A:
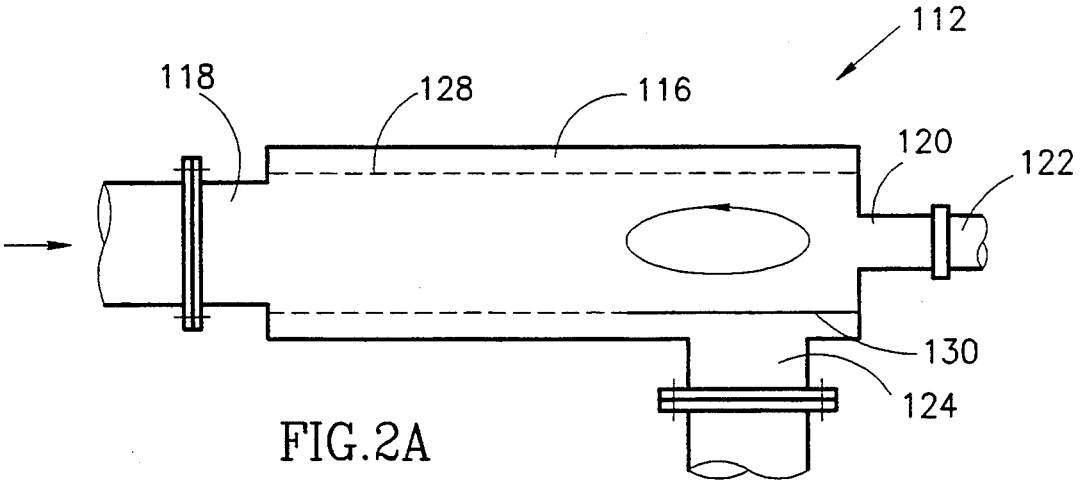
FIGS. 2*a*–2*g* are schematic views of the separation apparatus of the system shown in FIG. 1 including improvements and modifications for facilitating the evacuation of balls therefrom.
Figure 2B:
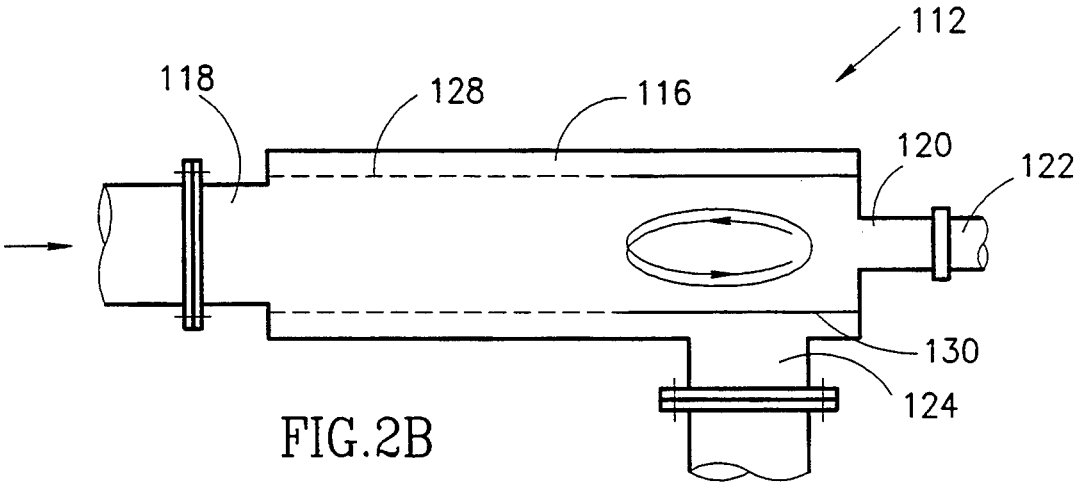
Figure 2C:
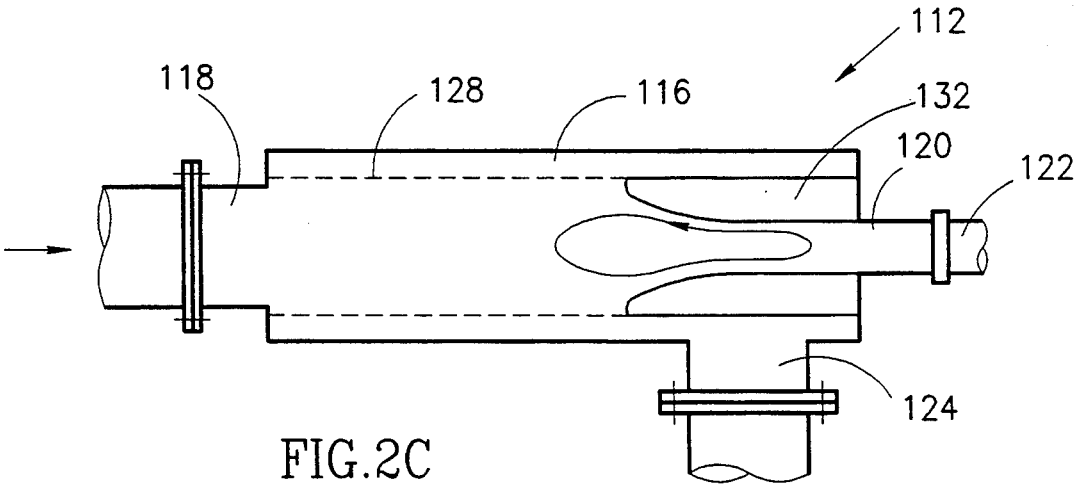

With reference now to FIGS. 2*a*–2*g*, there are illustrated further improvements for implementation in separation apparatus 112 for eliciting an environment conducive to the complete evacuation of balls 110 from sieve 128. FIGS. 2*a*–2*c* illustrate improvements to separation apparatus 112 in which fluid outlet 124 is disposed toward ball outlet 120 while FIGS. 2*d*–2*g* illustrate improvements to separation apparatus 112 in which fluid outlet 124 is disposed toward inlet 118. Generally, the arrangement in which fluid outlet 124 is disposed toward ball outlet 120 is preferred because the flow of fluid through fluid outlet 124 tends to urge balls 110 towards ball outlet 120, thereby facilitating their evacuation. However, in certain installations, space requirements do not allow for this arrangement and, therefore, fluid outlet 124 is disposed toward inlet 118.

Broadly speaking, the improvements are designed to achieve one or more of the following effects. First, reducing turbulence, particularly within the vicinity of ball outlet 120 as a result of the flow of fluid through fluid outlet 124. Second, urging balls 110 toward ball outlet 120 such that the pull of the vortex generated by the drop in pressure in ball conduit 122 has increased pulling power on balls 110. Third, the pull of the vortex generated by the drop in pressure in ball conduit 122 can be substantially directed toward balls 110 such that the vortex has increased pulling power thereon. And finally, compacting the motion of balls 110 such that the excursion of balls 110 from the axis of ball outlet 120 is decreased, thereby increasing the pulling power of the vortex generated by the drop in pressure in ball conduit 122.

With reference now to FIGS. 2*a*–2*c*, sieve 128 can be adapted to reduce turbulence within the vicinity of ball outlet 120 by providing a non-perforated portion 130 toward the end of sieve 128 disposed toward ball outlet 120. Non-perforated portion 130 can extend from a generally semi-trough shape (FIG. 2*a*) to a full cylindrical shape (FIG. 2*b*). Alternatively, rather than adapting sieve 128, separation apparatus 112 can include a funnel-shaped insert 132 having its narrow aperture toward ball outlet 120 and its wide aperture toward inlet 118. Sieve 128 and insert 132 form a substantially continuous wall to maintain a confined environment for balls 110 between inlet 118 and ball outlet 120. Insert 132 is designed to compact the ellipsoid motion of balls 110 such that the pull of the vortex is accentuated to facilitate evacuation of balls 110 through ball outlet 120.

Figure 2D:
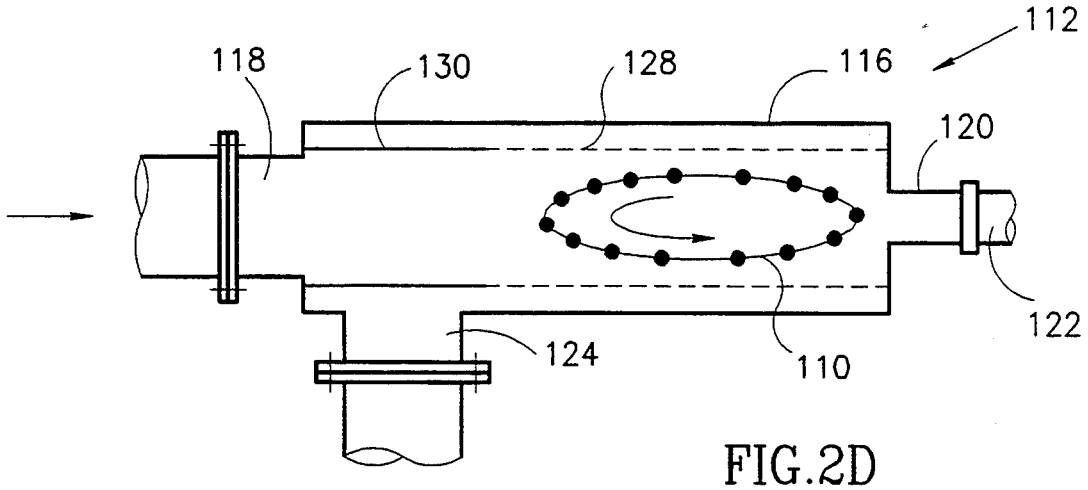
Figure 2E:
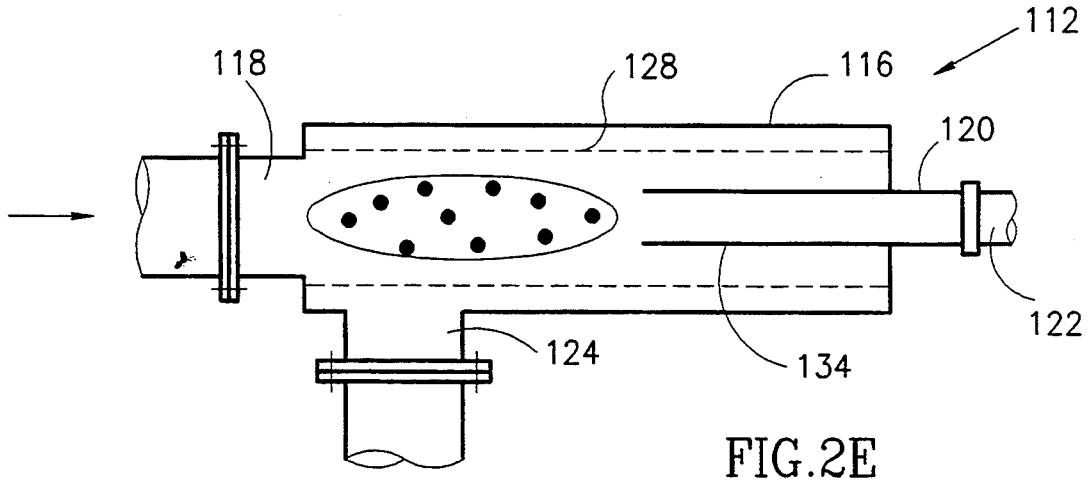
Figure 2F:
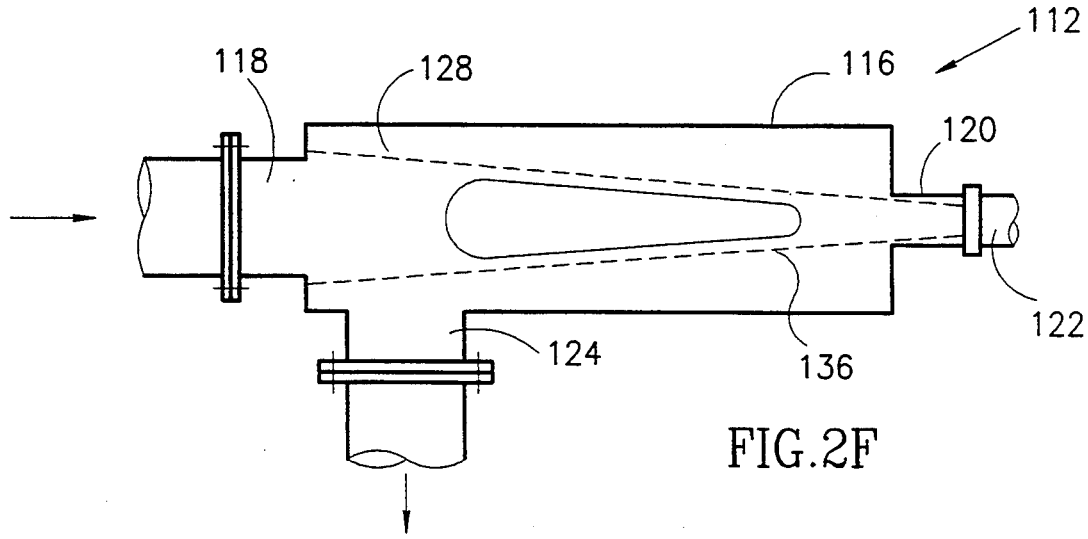
Figure 2G:
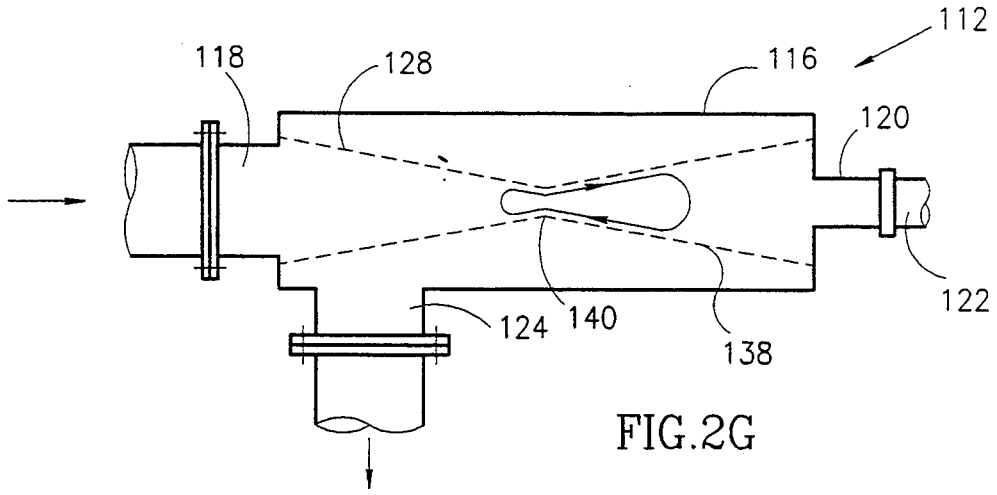

With reference now to FIGS. 2*d* and 2*e*, sieve 128 can include non-perforated portion 130 deployed to reduce turbulence within the vicinity of fluid outlet 124, thereby minimizing the disruptive influence on balls 110. Still again, separation apparatus 112 can be equipped with an insert 134 extending from ball outlet 120 toward inlet 118 for directing the pulling power of the vortex generated by the pressure drop in ball conduit 122 such that balls 110 are more readily evacuated from separation apparatus 112.

With reference now to FIGS. *2f* and *2g*, modifications to sieve 128 include a converging sieve 136 or a sieve 138 with a constricted waist portion 140. Sieve 136 compacts the excursion of balls 110 toward ball outlet 120 such that the pulling force of the vortex generated by the pressure drop in ball conduit 122 has an increased pull on balls 110. In contrast, sieve 138 maintains balls 110 in the vicinity of ball outlet 120 once they have passed through constricted waist portion 140, from where the vortex can readily evacuate them from separation apparatus 112.

Figure 3:
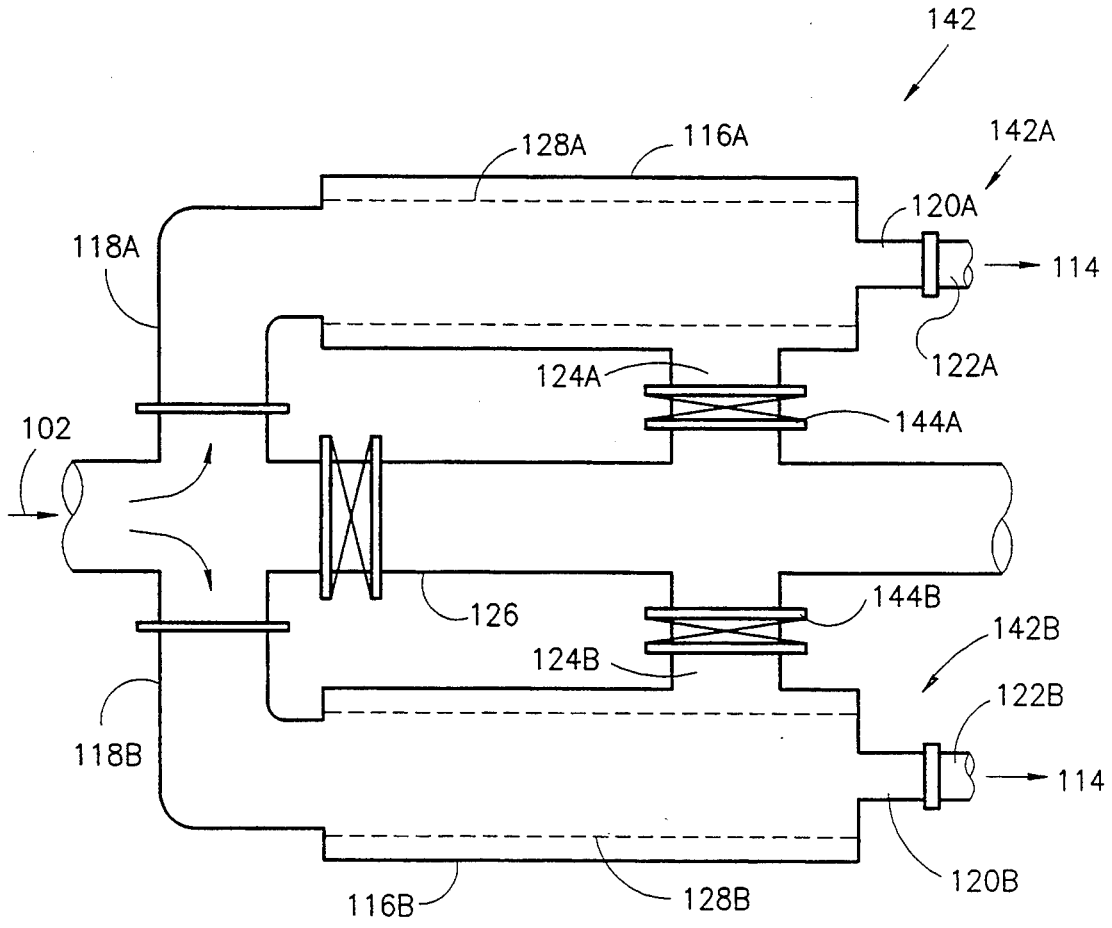
FIG. 3 is a schematic view of a second embodiment of a separation apparatus, constructed and operative according to the teachings of the present invention, including parallel sets of separation apparatus.

With reference now to FIG. 3, a separation apparatus, generally designated 142, is shown including two sets of separation apparatus 142*a* and 142*b*. Separation apparatus 142*a* and 142*b* have constructions similar to separation apparatus 112 and therefore similar elements are numbered likewise. For reasons to become apparent hereinbelow, inlet 118*a* is preferably substantially opposite to inlet 118*b* and separation apparatus 142 further includes valves 144*a* and 144*b* deployed on fluid outlets 124*a* and 124*b*, respectively.

The operation of separation apparatus 142 is now described. In normal operation, valves 144*a* and 144*b* are open such that fluid flowing through tubing 102 flows in substantially equal proportions through separation apparatus 142*a* and 142*b* to outlet fluid line 126. Hence, balls 110 are drawn in approximately equal quantities into both separation apparatus 142*a* and 142*b* after they have passed through tubing 102 following injection by ball recirculation apparatus 114. For the sake of clarity, balls 110 entrapped in separation apparatus 142*a* are denoted balls 110*a* while balls 110 entrapped in separation apparatus 142*b* are denoted balls 110*b*.

After entrapment of balls 110, one of valves 144*a* and 144*b* is temporarily closed, for example valve 144*a*, in preparation for the evacuation, in this case, of balls 110*a* from separation apparatus 142*a*. Closing valve 144*a* causes both the fluid originally flowing through separation apparatus 142*a* to be diverted such all the fluid flowing through tubing 102 flows through separation apparatus 142*b* and balls 110*a* to be substantially stationary within the confines of sieve 128*a*. The standing of balls 110*a* facilitates their evacuation by the intense vortex generated when fluid flows through separation apparatus 142*a* again due to the activation of ball recirculation apparatus 114 to drop the prevailing pressure in ball conduit 122*a* below the prevailing pressure at inlet 118*a*. After evacuation of balls 110*a*, valve 114*a* is opened and valve 144*b* is temporarily closed, thereby enabling the evacuation of balls 110*b* from separation apparatus 142*b* in the same manner. After balls 110*b* are evacuated, valve 144*b* is reopened such that separation apparatus 142 reverts back to its normal operation.

While the invention has been described with respect to a limited number of embodiments, it will be appreciated that many variations, modifications and other applications of the invention may be made.

What is claimed is:

1. A separation apparatus for separating balls circulating through tubing having an upstream side and a downstream side at the downstream side of the tubing, the tubing having an outlet header with a neck, the separation apparatus delivering the balls to a ball recirculation apparatus for recirculation to the upstream side of the tubing, the separation apparatus comprising:

(a) a conduit having an inlet in flow communication with the downstream side of the tubing, a ball outlet connected to the ball recirculation apparatus and a fluid outlet; and (b) a generally cylindrical sieve substantially extending lengthwise between said inlet and said ball outlet in said conduit, said sieve having a first end toward said inlet and a second end toward said ball outlet, said first end and said second end being permanently open, said sieve continuously separating balls from fluid flowing from said inlet to said fluid outlet.

2. The apparatus as in claim 1 wherein the cross-sectional area of said inlet is substantially equal to the cross-sectional area of the neck of the outlet header of the tubing.

3. The apparatus as in claim 1 wherein the cross-sectional area of said sieve is substantially equal to the cross-sectional area of the neck of the outlet header of the tubing.

4. The apparatus as in claim 1 wherein the total area of said sieve is at least approximately five times its cross sectional area.

5. The apparatus as in claim 1 wherein the total open area of said sieve is at least approximately five times the cross-sectional area of the neck of the outlet header of the tubing.

6. The apparatus as in claim 1 wherein said ball outlet is located substantially center to said sieve.

7. The apparatus as in claim 1 further comprising means for reducing turbulence in the flow of fluid within the vicinity of said fluid outlet.

8. The apparatus as in claim 1, further comprising means for reducing turbulence in the flow of fluid within the vicinity of said ball outlet.

9. The apparatus as in claim 1, further comprising means for urging said plurality of balls toward said ball outlet.

10. The apparatus as in claim 1, further comprising means for compacting the motion of said plurality of balls such that the excursion of said plurality of balls from the axis of said ball outlet is decreased.

11. The apparatus as in claim 1, wherein said sieve includes a non-perforated portion.

12. The apparatus as in claim 1, wherein said sieve converges from said inlet towards said ball outlet.

13. The apparatus as in claim 1, wherein said sieve includes a constricted waist portion.

14. The apparatus as in claim 1, further comprising an insert extending from said ball outlet toward said inlet.

15. The apparatus as in claim 1, further comprising a second separation apparatus in parallel with said first separation apparatus, said second separation apparatus including a conduit having an inlet in flow communication with the downstream side of the tubing, a ball outlet connected to the inlet of said ball recirculation apparatus and a fluid outlet connected to an outlet fluid line, and a generally cylindrical sieve substantially extending between said inlet and said ball outlet.

16. The apparatus as in claim 15, wherein said inlet of said second separation apparatus is substantially opposite said inlet of said first separation apparatus.

17. The apparatus as in claim 15, further comprising first and second valves deployed on said first and second fluid outlets, respectively.

* * * * *